United States Patent [19]

Wiebe

[11] 4,072,112

[45] Feb. 7, 1978

[54] RESILIENTLY BIASING TRUCK PEDESTAL BEARING RETENTION ASSEMBLY

[75] Inventor: Donald Wiebe, Sewickley, Pa.

[73] Assignee: A. Stucki Company, Pittsburgh, Pa.

[21] Appl. No.: 688,942

[22] Filed: May 24, 1976

[51] Int. Cl.[2] ..... B61F 5/34; B61F 5/52; B61F 15/06; B61F 15/20

[52] U.S. Cl. ..... 105/221 K; 105/224.1

[58] Field of Search ..... 105/218 R, 221 K, 224 R, 105/224.1, 225

[56] References Cited

U.S. PATENT DOCUMENTS

| | | | |
|---|---|---|---|
| 702,025 | 6/1902 | McElroy | 105/218 R X |
| 809,744 | 1/1906 | Ramsdell | 105/225 X |
| 2,165,662 | 7/1939 | Swan | 105/225 X |
| 2,250,568 | 7/1941 | Borup | 105/224 R |
| 2,598,082 | 5/1952 | Tack | 105/224 R |
| 3,905,307 | 9/1975 | MacDonnell et al. | 105/221 K |

*Primary Examiner*—Lawrence J. Oresky
*Assistant Examiner*—Howard Beltran
*Attorney, Agent, or Firm*—Howard E. Sandler

[57] ABSTRACT

A method and apparatus for resiliently positioning and restraining a freight car truck axle bearing with respect to a side frame pedestal opening.

13 Claims, 3 Drawing Figures

RESILIENTLY BIASING TRUCK PEDESTAL BEARING RETENTION ASSEMBLY

In modern railway freight trucks of a type having narrow pedestal side frames, bearing adapters are disposed intermediate the side frame pedestal opening and the respective axle bearing carrier. In assembled position the adapters are permitted a limited, transverse movement within the side frame pedestal opening. This latter mentioned movement or clearance is necessary to allow the wheel sets to go out of square with respect to the side frame to the bolster gib limit without the adapter and the bearing carrier engaging and camming the pedestal jaws. Such motion is initially limited to the longitudinal space between the adapter and the pedestal opening keys or stops, approximately one eighth inch when installed. However, wear and impact between these two limits eventually results in direct contact between the journal or bearing carrier and the pedestal jaws with a resulting potential motion of the bearing carrier within the pedestal opening of approximately ½ inch.

Since the narrow pedestal side frame trucks have become standard in the industry, the clearance and resultant movement or freedom permitted between the bearing carrier and the pedestal jaws has resulted in certain problems, for example: motion between the bearing carrier and pedestal jaws causes uneven wear and potential impact forces; and excessive wheel set losenging due to wider allowable boltser gib clearance with resulting higher flange forces between rails and wheels around curves. This latter mentioned problem of excessive wheel set losenging causes a more extreme flange wear or abrasion on one flange of a given wheel set and also results in unsymmetrical wheel tread wear. Unsymmetrical wheel wear is extremely degenerative and progressively worsens as unsymmetrical differences in geometry of the two wheels of a given wheel set increases. Furthermore, wheel sets of a given truck become cyclically non-parallel as the bearing carrier center distance increases on one side frame while decreasing on the other when the wheel sets hunt or oscillate laterally at higher speeds thereby causing even more severe hunting response than with substantially parallel axles. This latter mentioned cyclic non-parallel movement will result in excessive oscillations or truck instability to occur at relatively lower speeds. In other words with the pedestal opening freedom of presently utilized narrow pedestal side frame trucks, the truck is difficult to control by the presently utilized truck swivel restraining type of hunting control devices.

A still further problem with narrow pedestal trucks occurs as a result of train action or at classification yards when severe impact forces which are transmitted through the truck bolster to the side frame pedestal jaws and thence to the bearing carriers and wheel sets. The greater the bearing carrier pedestal jaw opening clearance, the greater the potential damage to the bearing carrier because of impact from an adjacent pedestal jaw.

By means of this invention which includes elastomeric positioning means disposed intermediate the bearing carrier and one of the pedestal jaws to bias the bearing carrier or adapter into direct communication or engagement with the opposite pedestal jaw, the hereinabove mentioned problem caused by transverse or angular movement between the bearing carrier and pedestal jaws is overcome or in the least limited to a constrained relative angular as well as linear displacement of the wheel set to the side frame. Specifically, the controlled engagement and of the bearing carrier in the pedestal opening aids in decreasing wear and reducing impact forces on the bearing carrier and additionally provides a retarding force to aid in the prevention of extreme loosening of the wheel sets.

These and other objects and advantages of the present invention will become more readily apparent upon a reading of the following description and drawings in which.

Figure 1:
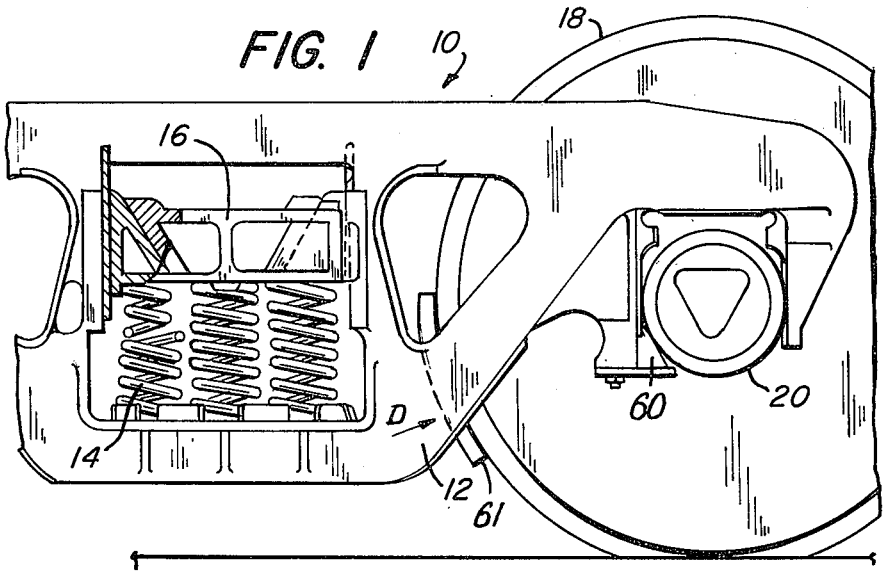
FIG. 1 is a partial side view of a standard narrow pedestal railway truck of a type adapted to incorporate the bearing positioning means of the present invention.

FIG. 1 illustrates a prospective schematic view of a standard four wheel narrow pedestal railway truck, generally illustrated at 10, comprising a spaced pair of side frames 12 in which spring groups 14 are included to support a bolster 16. Wheels 18 are suitably journaled to axles 20 which are in turn carried by side frames 12 through the use of roller bearing assemblies 22.

Inasmuch as the invention herein is primarily directed to a means for resiliently positioning and restraining roller bearing assemblies 22 and the primary elements set forth hereinabove are well known in the art further description of such elements will not be set forth hereinafter except where necessary to describe the invention herein.

Figure 2:
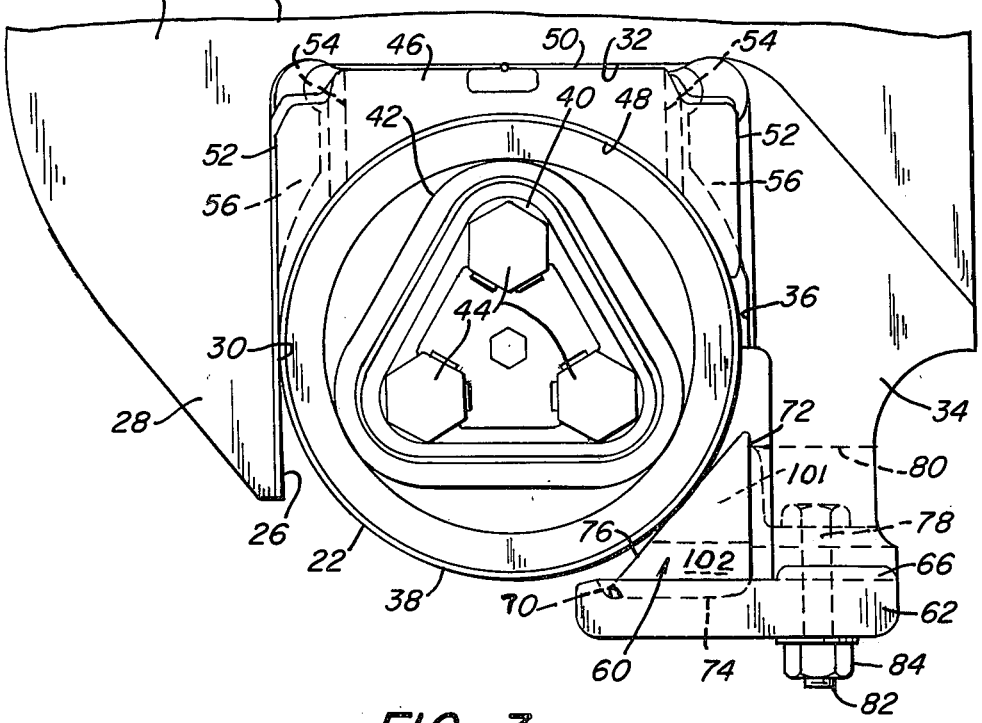
FIG. 2 is a fragmentary elevational view of one end of a railway truck side frame and axle including a roller bearing resiliently positioned within the side frame pedestal opening in accordance with the principles of the present invention.
Figure 3:
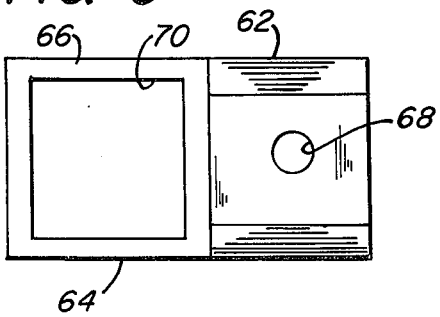
FIG. 3 is a plan view of the journal retaining key illustrated in FIG. 2 which supports a wedge biasing means positioned thereon all in accordance with the principles of the present invention.

FIG. 2 illustrates one end of a side frame 12 which terminates in pedestal portion 24 having a downwardly open pedestal opening 26 therewithin. Pedestal opening 26 is formed by: a vertically disposed outboard pedestal jaw 28 having an inner peripheral surface 30; a pedestal roof 32; and a vertically disposed inboard pedestal jaw 34 having an inner peripheral surface 36.

As illustrated in FIGS. 1 and 2 a roller bearing assembly 22 is carried adjacent each journal end of axles 20. Bearing assemblies 22 are of known design and as shown are pressed on the journal end of axle 20 as a sealed unit which includes a cylindrical bearing carrier 38 which coaxially receives an outer cone and roller bearing (not shown) therewithin. Bearing assemblies 22 are secured to axles 20 by locking plate 40 which retains the axle end cap 42 in position by a plurality of cap screws 44.

A bearing adapter 46 is provided intermediate the upper portion of each pedestal opening 26 and a respective bearing assembly 22. Bearing adapters 46 are of a known design and as illustrated the downwardly facing surface 48 of the adapter 46 is concaved to correspond to the adjacent cylindrical surface of bearing carrier 38 and the upper surface 50 of the adapter 46 is of a cylindrical convex configuration. In assembly, surface 50 bears against the pedestal roof 32 and is in slight rocking relationship therewith due to the convex configuration of surface 50. In addition, the side surfaces 52 of adapter 46 are provided with keyways 54 therein which loosely receive adjacent keys 56 therewithin. Keys 56 are integrally formed on pedestal opening surfaces 30 and 36 and extend inwardly therefrom. It is to be noted that the distance intermediate adapter surfaces 52 is substantially equal to the outer diameter of roller bearing assembly 22 and is less than the distance intermediate pedestal opening surfaces 30 and 36.

With a configuration of bearing assembly 22 and adapter 46 such as discussed hereinabove the polygonal configuration of pedestal openings 26 is adapted to receive the arcuate configuration of the bearing assembly 22 therewith. Furthermore, the keys 56 and cooperating keyways 54 aid in retaining adapter 46 in position within pedestal opening 26. Furthermore, it is to be recognized that narrow pedestal trucks are structured to permit a degree of lateral and/or angular movement of wheel sets with respect to side frames. Also, the configurations of bearing assembly 22 and adapter 46 are such that slight overall transverse clearance, longitudinal to the side frame, for example one eighth inch when the truck is running new to one quarter inch to one half inch after wear occurs between cooperating keyways 54 and keys 56, is maintained with respect to the pedestal opening thereby permitting displacement longitudinally of the axle 20 and respective roller bearing assemblies 22 with respect to the side frames 12.

The clearance and resultant movement or displacement of the axle 20 and respective roller bearing assembly 22 with respect to the side frames as discussed hereinbefore has heretofore resulted in certain problems, for example: contact between the bearing carrier 22 and pedestal jaws 28 and 34 occur in a random fashion on a railway truck 10 and cause impact forces at the contact surfaces; and excessive wheel set losenging with resultant potential for degenerative tangential rail and wheel frictional forces on curves. To alleviate these problems, the present invention includes an elastomeric positioning and constraining means, shown as wedge block 60, which is positioned intermediate a pedestal retaining bracket 62 and a respective roller bearing assembly 22. As will be seen from the discussion hereafter, wedge block 60 is positioned in a manner that the roller bearing assembly 22 is biased into controlled engagement with the inner surface 30 of the outboard pedestal jaw 28 thereby decreasing the wear of the metal to metal contact surfaces, reducing impact forces and additionally providing a restraining force to prevent extreme or unrestrained losenging of the wheel sets.

Pedestal retaining bracket 62 comprises; a generally polygonal body portion 64 having an upper seating surface 66; a bore 68 extending through seating surface 66 adjacent one end portion of bracket 62; and a grooved wedge seat 70 formed within seating surface 66 adjacent the other end portion of bracket 62. Wedge block 60 is of a suitable elastomeric material which will yield the desired operational characteristics as discussed hereinafter and as shown is of a generally right triangular configuration wherein the two surfaces which form the right triangle are designated 72 and 74 and the surface of the hypotenuse of the triangle is designated at 76. The triangular configuration of wedge block 60 provides both a vertical and horizontal resilient and restraining force component. Furthermore, it is to be noted that the configuration of surface 72 conforms generally to the polygonal peripheral configuration of the grooved wedge seat 70.

In assembled position the lowermost portion of wedge block 60 is received within grooved wedge seat 70 of side frame key 62 in a manner that surface 72 is seated on the mating innermost surface of the seat 70 and surface 74 extends vertically upwardly therefrom. The assembly of bracket 62 and wedge block 60 are in turn releasably carried by the inboard pedestal jaw 34 adjacent the lower end thereof in a manner that surface 74 of wedge block 60 abuts an adjacent portion of the inner surface 36 of the inboard pedestal jaw 34. Bracket 62 may be releasably retained in this assembled position in any suitable manner which, as shown, includes a bore 78 which extends vertically through a lower portion of inboard pedestal jaw 34 with the upper end of bore 78 opening into an opening 80 which extends transversely between surface 36 and the outermost surface of jaw 34.

With an arrangement of bracket 62, wedge block 60 and inboard pedestal jaw 34 as discussed hereinabove, bores 68 and 78 are coaxially aligned and a bolt 82 is received therethrough. Nut 84 is then tightened until surface 70 of wedge block 60 is raised vertically a sufficient distance to firmly engage an adjacent peripheral surface of the roller bearing assembly 22 and to bias the roller bearing assembly 22 out of direct engagement with the inboard pedestal jaw surface 36 and into engagement, after wear occurs between cooperating keyways 54 and keys 56, with the outboard pedestal jaw surfaces 28. Prior to such wear the direct engagement occurs between cooperating keys 54 and keys 56. It is to be noted at this point the inclusion of applicant's invention of a type described hereinabove is readily adaptable to retrofit situations for existing inboard pedestal jaws of narrow pedestal trucks include a bore 78 therethrough. Thus, in most retrofit applications of the present invention no field alterations are required to be made to existing pedestal railway trucks other than unbolting existing side frame keys or brackets and inserting retaining brackets 62 and wedge blocks 60 constructed in a form as described herein. It is to be further noted that the roller bearing assembly is biased toward the outboard pedestal jaw surface 28 as is the biasing force resulting from the application of truck brakes, such brakes being schematically illustrated at 61 and being applied in the direction "D," thereby ensuring that the wedge block 60 is not deflected by brake forces with eventual logenging effects.

It is desirable that an initial preload force, for example 1000 to 5000 pounds, be established in wedge block 60. This preload may be varied by adjustment of the nut 84 to vary the relative vertical location of retaining bracket 62. Additional means of varying the preload may be accomplished in a variety of manners, for example: utilizing wedge blocks of various physical configurations or hardness characteristics; utilizing washers disposed intermediate bracket 62 and inboard pedestal jaw 34; or utilizing shims positioned intermediate surface 74 of wedge block 60 and the grooved wedge seat 70.

Wedge block 60 is formed of a suitable elastomer, for example one having a hardness in the range of 50 to 60 Shore D if the wedge block 60 is formed of a single material. On the other hand, a more preferable makeup of wedge block 62 is to have an upper portion of one material 101 and a lower portion 102 of a stiffer material. This arrangement is preferable to allow a relatively soft upper portion which is in direct contact with the bearing carrier which will readily deform to conform to the outer periphery of the roller bearing thereby resulting in superior control characteristics while simultaneously providing the harder lower portion for limiting the total deflection of the wedge block 62 and to more readily maintain the bias established. If block 60 is formed entirely of an elastomer material it would be preferable that the top $\frac{1}{4}$ to $\frac{1}{2}$ should be formed of an elastomer having a hardness of 40 to 55 Shore D and the lower $\frac{1}{2}$ to $\frac{3}{4}$ should be formed of an elastomer having a hardness of 50–65 Shore D.

It is to be understood that the particular embodiment described hereinbefore is merely a preferred embodiment and various alterations can be made thereto by those skilled in the art without departing from the scope of the instant invention, for example: the lower portion of wedge block 62 can be formed of metal with an upper elastomeric portion molded thereto; alterations to the physical configuration of wedge block 60 and side frame retaining brackets 62 may be made; arrangements are contemplated to dispose a wedge block intermediate to outboard pedestal jaw 28 and the roller bearing assembly 22 rather than disposing the wedge block intermediate the inboard pedestal jaw 34 and the roller bearing assembly 22; and the like. Accordingly, it is to be understood that the invention herein is to be defined only by the claims set forth hereinafter.

What is claimed is:

1. A side frame bracket assembly for positively retaining an axle bearing carrier assembly within the pedestal opening of a narrow pedestal type side frame of a railway truck assembly comprising: a retaining bracket adapted to be carried by a pedestal jaw of such a pedestal opening adjacent a lower end portion thereof; biasing means adapted to be carried by said bracket and disposed intermediate such a pedestal jaw and such a bearing carrier assembly and operative to bias such a bearing carrier assembly out of communication with such a pedestal jaw and into communication with the other pedestal jaw of such a pedestal opening continuously during all normal moving operation of such a railway truck assembly.

2. A side frame bracket assembly as is specified in claim 1 wherein at least the portion of said biasing means adapted to engage such a bearing carrier is formed of elastomeric material.

3. A side frame bracket assembly as is specified in claim 1 wherein said biasing means is formed of elastomeric material.

4. A side frame bracket assembly as is specified in claim 3 wherein said bearing means has a generally triangular cross section and when said biasing means is operatively carried by said bracket the hypotenuse thereof engages such a bearing carrier assembly, one leg thereof engages such a pedestal jaw and the other leg is seated on said bracket.

5. A side frame bracket assembly as is specified in claim 4 wherein said bearing means is formed in upper and lower portions having differing physical properties with said upper portion having a lower Shore D hardness than said lower portion.

6. A side frame bracket assembly as is specified in claim 1 additionally including adjustment means cooperable with said bracket and such a side frame to selectively vary the bias of said biasing means.

7. A side frame bracket assembly as is specified in claim 1 wherein such first and second mentioned pedestal jaws are respectively the inboard and outboard pedestal jaws of such a pedestal opening.

8. In a railway truck assembly having narrow pedestal type side frames which captively receive an axle bearing carrier assembly in the downwardly open pedestal opening formed by a pedestal roof and transversely spaced vertically extending inboard and outboard pedestal jaws, the improvement comprising: biasing means disposed intermediate one of said jaws and said bearing carrier and operative to bias said bearing carrier out of communication with said one of said pedestal jaws and into communication with the other of said pedestal jaws during all normal operations of such a railway truck assembly; and said biasing means continuously imparts both upward and horizontal force components.

9. A railway truck assembly as is specified in claim 8 wherein said biasing means comprises a wedged shaped elastomeric member.

10. A method of positively retaining an axle bearing carrier assembly within the pedestal opening of a narrow pedestal type side frame of a railway truck assembly comprising the steps of: biasing said bearing carrier assembly out of communication with one pedestal jaw of such a pedestal opening and into communication with the other pedestal jaw of such a pedestal opening; maintaining said last mentioned communication through the normal operation of said railway truck assembly; and said biasing continuously imparting both upward and horizontal force components.

11. A method as specified in claim 10 wherein said biasing is away from the inboard pedestal jaw and toward the outboard pedestal jaw of such a pedestal opening.

12. A method as specified in claim 10 wherein said biasing is by elastomeric biasing means and including the additional step of applying an upwardly directed preload force to said biasing means.

13. A method as specified in claim 10 wherein said biasing is towards the direction of application of the brakes of said railway truck assembly.

* * * * *

UNITED STATES PATENT OFFICE

CERTIFICATE OF CORRECTION

PATENT NO. : 4,072,112

DATED : February 7, 1978

INVENTOR(S) : Donald Wiebe

It is certified that error appears in the above-identified patent and that said Letters Patent are hereby corrected as shown below:

Claim 4, line 6, after "leg" insert -- thereof --

Claim 8, line 7, after "said" insert -- pedestal --

Signed and Sealed this

Sixteenth Day of May 1978

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,072,112

DATED : 7 February 1978

INVENTOR(S) : Donald Wiebe

It is certified that error appears in the above-identified patent and that said Letters Patent are hereby corrected as shown below:

Claim 4, line 2, delete "bearing" and substitute --biasing--

Claim 5, line 2, delete "bearing" and substitute --biasing--

Signed and Sealed this

*Nineteenth* Day of *May 1981*

[SEAL]

*Attest:*

RENE D. TEGTMEYER

*Attesting Officer*

*Acting Commissioner of Patents and Trademarks*